US005425790A

United States Patent [19]

Liotta, Jr. et al.

[11] Patent Number: 5,425,790

[45] Date of Patent: Jun. 20, 1995

[54] DIESEL FUEL

[75] Inventors: Frank J. Liotta, Jr., Collegeville; David C. Dehm, Thornton, both of Pa.

[73] Assignee: ARCO Chemical Technology, L.P., Greenville, Del.

[21] Appl. No.: 190,977

[22] Filed: Feb. 3, 1994

Related U.S. Application Data

[63] Continuation of Ser. No. 996,327, Dec. 23, 1992, abandoned.

[51] Int. Cl.[6] ..... C10L 1/18

[52] U.S. Cl. ..... 44/443; 44/447

[58] Field of Search ..... 44/443, 447

[56] References Cited

U.S. PATENT DOCUMENTS

| | | | |
|---|---|---|---|
| 2,221,839 | 11/1940 | Lipkin | 44/443 |
| 2,331,386 | 10/1943 | Gaylor . | |
| 2,655,440 | 10/1953 | Barusch et al. . | |
| 2,763,547 | 9/1956 | Barusch et al. . | |
| 3,291,580 | 12/1966 | Malick . | |
| 3,416,902 | 12/1968 | Anderson et al. . | |
| 3,511,218 | 2/1970 | Lazaros | 123/119 |
| 3,577,228 | 5/1971 | Rai et al. . | |
| 3,594,138 | 7/1971 | Badin . | |
| 3,594,140 | 7/1971 | Badin . | |
| 3,615,292 | 10/1971 | Badin . | |
| 3,658,494 | 4/1972 | Dorer, Jr. | 44/443 |
| 4,298,352 | 11/1981 | Blysing | 44/443 |
| 4,753,661 | 6/1988 | Nelson et al. . | |
| 4,891,049 | 1/1990 | Dillon et al. . | |
| 4,904,279 | 2/1990 | Kanne et al. . | |
| 5,004,480 | 4/1991 | Kanne . | |
| 5,055,112 | 10/1991 | Duncan et al. | 44/445 |
| 5,314,511 | 5/1994 | Liotta, Jr. et al. | 44/447 |

FOREIGN PATENT DOCUMENTS

| | | | |
|---|---|---|---|
| 1180895 | 1/1985 | Canada . | |
| 80100827.7 | 9/1980 | European Pat. Off. . | |
| 82109266.5 | 4/1983 | European Pat. Off. . | |
| 2064681 | 1/1973 | Germany | 44/443 |
| 59-232176 | 12/1984 | Japan . | |
| 0565465 | 11/1944 | United Kingdom | 44/443 |
| 1246853 | 9/1971 | United Kingdom . | |

OTHER PUBLICATIONS

Article entitled "Diesel Fuel Modification for Reduced Exhaust Emissions," by Richard E. Winsor and Danney E. Larkin.

*Impact of U.S. Environmental Regulations on Fuel Quality, ASTM STP 1160,* Kurt H. Strauss and William Dukek, eds., American Society for Testing and Materials, Philadelphia, (month unavailable 1992.).

*Primary Examiner*—Margaret Medley

*Attorney, Agent, or Firm*—William C. Long

[57] ABSTRACT

The present invention relates to a low sulfur diesel fuel which contains a propylene, butylene or ethylene glycol monoalkyl ether or polyol in amount sufficient to reduce particulate matter emissions.

6 Claims, No Drawings

DIESEL FUEL

RELATED APPLICATION

This application is a continuation of application Ser. No. 07/996,327 filed Dec. 23, 1992, now abandoned.

BACKGROUND OF THE INVENTION

1. Field of the Invention

The present invention relates to an improved diesel fuel which has reduced particulate matter emission characteristics and which contains an effective amount of a butylene, propylene or ethylene glycol monoalkyl ether having the formula $$R-(O-\underset{\underset{R_1}{|}}{A}-)_nOH$$

wherein R is an alkyl group, A is a $C_2$–$C_4$ alkylene group, $R_1$ is hydrogen or an alkyl group having 1–10 carbon atoms, and n is an integer of 1 to 10, or a polyol where R is hydrogen and n is at least 4.

2. Description of the Prior Art

Diesel fuels are known which contain a synergistic cetane improving additive combination of a peroxidic component and an aliphatic polyether of the formula $R(-O-X)_nO-R^1$ where R and $R^1$ are alkyl groups, X is an alkylene group and n is an integer. See U.S. Pat. No. 2,655,440 and divisional U.S. Pat. No. 2,763,537.

European Application 80-100827.7 describes the use of various propylene glycol mono- an di-ethers as a component of diesel fuels. The compositions described in this reference involve a multicomponent formulation which includes poly-ethers, acetals, lower alkanols, water and only up to 85 volume % diesel fuel hydrocarbons.

U.K. 1,246,853 describes the addition of dialkyl ethers of propylene glycol as smoke suppressants in diesel fuel.

U.S. Pat. No. 4,753,661 describes a fuel such as diesel fuel containing a conditioner which comprises a polar oxygenated hydrocarbon, a compatibilizing agent which is an alcohol, aromatics, and a hydrophilic separant which may be a glycol monoether.

Japanese Published Application 59-232176 describes the use of the di-ethers of various polyoxyalkalene compounds as diesel fuel additives.

The addition of glycol ethers and metallic smoke suppressants have been found to reduce the smoke and soot emissions. These metallic smoke suppressants are typically metal salts of alkonoic acids. Both the health and environmental risks of these salts, especially those of barium, are of concern. See U.S. Pat. Nos. 3,594,138, 3,594,140. 3,615,292 and 3,577,228.

European Application 82-109,266.5 describes the use of ethers to reduce soot. However, a number of these ethers are unable to be used commercially in the U.S. because the resulting fuel does not meet the flash specification of 52° C. This application also teaches that glycol ethers are not highly effective at reducing exhaust emissions. Based on these teachings, our invention would be unexpected.

Japanese Patent Application 59-232176 teaches that glycol ethers of the formula $R_1-O-(CHR_2-CH_2-O-)_nR_3$ where n is less than five have the effect of reducing particulate, CO and HC emissions which effect is weak. This is in direct contrast to our invention.

Winsor and Bennethum (SAE 912325) describe the use of the glycol ether diglyme to reduce particulate emissions. In addition to being costly to produce, diglyme is highly toxic and has been associated with increased rates of miscarriages. Glycol ethers based on the higher alkylene oxides, especially propylene and the butylenes, are far less toxic than those based on ethylene oxide. Glycol ethers based on ethylene oxide also have unfavorable water partition coefficients. The water partition coefficient for diglyme is greater than 17. Thus virtually eliminating it for any commercial use as a diesel fuel additive.

The addition of dialkyl carbonates and dialkyl dicarbonates, particularly dimethyl carbonate, to diesel fuel has been described to reduce exhaust emissions from compression ignition engines. See U.S. Pat. Nos. 2,311,386, 4,891,049, 5,004,480 and 4,904,279. The high volatility of the lower alkyl carbonates prevents their addition in substantial amounts to typical D-2 diesel fuel. While some dicarbonates have lower volatilities, their poor hydrolytic stability precludes their commercial use.

The Clean Air Act Amendments of 1990 have established certain emission standards for heavy duty diesel engines, in particular with regard to nitrogen oxide and particulate matter emissions. The contribution of diesel fuel sulfur content to exhaust particulates has been well established, and has led to an EPA regulation which will require highway diesel fuels to contain no more than 0.05 wt. % sulfur. In 1991, particulate matter emissions were required to drop from 0.60 to 0.25 grams/BHP-hr., and in 1994 the emission limit is 0.10. Similarly, nitrogen oxide will decrease from 6.0 to 5.0 in 1994 and from 5.0 to 4.0 grams/BHP-hr. in 1998. The California Air Resources Board (CARB) has issued regulations that are viewed as more difficult to meet than the EPA targets. To qualify a diesel fuel in California, emissions must be no greater than the CARB reference fuel which contains 0.05 wt. % maximum sulfur, 10% maximum aromatics and a minimum cetane number of 48.

Many strategies are being used by the industry to reduce emissions. Improved heavy duty diesel engine designs including higher injection pressures, turbocharging, air intercooling, retarded injection timing through electronic tuning control, exhaust gas recycle and exhaust aftertreatment devices all lower emissions.

For this advanced technology to work, a high quality, low emissions diesel fuel is required in addition to the use of various fuel additive improvements including cetane improver use, diesel fuel detergents to keep fuel injectors clean and improved low ash engine oils. A combination of these strategies will be utilized to meet new clean air standards. The key issue is to find the most effective combination of technologies which offer the best cost/performance.

Fuel regulations, especially those promulgated in California, will require costly changes in diesel fuel composition. Desulfurization to achieve the 0.05 wt. % sulfur target is easily accomplished through mild hydrogenation. However, refiners must use deep hydrogenation to decrease aromatic content from the current 20–50% aromatic level down to 10%. Many refiners have elected to exit the California diesel fuel market rather than making the high capital investment required for deep hydrogenation. At least one refiner was able to qualify a diesel fuel for California by lowering the aromatics to 19% and increasing the cetane number from 43 for a typical fuel up to around 60 using an alkyl nitrate cetane improver.

The present invention relates to an oxygenated alkyl glycol ether or polyol which, when incorporated in standard 30–40% aromatic containing diesel fuel, provides reduced emissions of particulate matter, hydrocarbons, carbon monoxide and unregulated aldehyde emissions. For 1994, the engine manufacturer strategy to reduce emissions to meet guidelines involves using electronic tuning to reduce particulates. In this strategy, nitrogen oxide, hydrocarbons, and carbon monoxide emissions are within EPA requirements. However, for 1998, nitrogen oxide emissions need to be further reduced. If an oxygenated fuel can lower particulate matter emissions another 10–20%, this will provide additional tuning flexibility for nitrogen oxide. The strategy would be to lower particulates to meet the 0.1 gram/BHP-hr. target using a combination of oxygenate additive and tuning. This widens the window for nitrogen oxide tuning which needs to be reduced from 5.0 to 4.0 grams/BHP-hr. Particulate reductions will also provide an opportunity to further lower nitrogen oxide using exhaust gas recycle. At high particulate matter levels, the particulates block and foul the exhaust gas recycle lines and orifices, and contaminate engine oil. Lower particulates via the use of alkyl glycol ethers or polyols could allow greater use of this new technology.

BRIEF DESCRIPTION OF THE INVENTION

In accordance with the invention, reduced emissions of particulate matter are achieved with diesel fuel having incorporated therein an effective amount of a butylene, propylene or ethylene glycol monoether or polyol having the formula $$R-(O-\underset{\underset{R_1}{|}}{A}-)_nOH$$

wherein R is an alkyl group, A is a $C_2$–$C_4$ alkylene group, $R_1$ is hydrogen or an alkyl group having 1–10 carbon atoms, and n is an integer of 1 to 10, preferably 1 to 5 for the monoethers, and where R is hydrogen and n is 4 to 30, preferably 10 to 25 for the polyols.

DETAILED DESCRIPTION

The hydrocarbon based diesel fuels utilized in the practice of this invention are comprised in general of mixtures of hydrocarbons which fall within the diesel fuel boiling range, typically about 160° to about 370° C. The fuels are often referred to as middle distillate fuels since they comprise the fractions which distill after gasoline. The diesel fuels of the invention have a low sulfur content, i.e. not more than 500 ppm by weight, preferably not more than 100 ppm and preferably not more than 60 ppm sulfur by weight. Aromatic content is in the range of 10–50% by volume, preferably 20–35% by volume.

The monoether component employed in the invention has the formula $$R-(O-\underset{\underset{R_1}{|}}{A}-)_nOH$$

wherein R is an alkyl group preferably having 1–10 carbon atoms, A is an alkylene group having 2–4 carbon atoms such as $$-\underset{\underset{|}{}}{CH}-CH_2-,\ -CH_2-\underset{\underset{|}{}}{CH}-CH_2-,\ -\underset{\underset{|}{}}{CH}-CH_2-CH_2-,$$

$$-CH_2-\overset{\overset{CH_3}{|}}{\underset{\underset{|}{}}{C}}-CH_2-,\ -\overset{\overset{CH_3}{|}}{\underset{\underset{|}{}}{C}}-CH_2-,\ -\overset{\overset{CH_3}{|}}{\underset{\underset{|}{}}{C}}-CH_2-CH_2-,$$

and the like, and $R_1$ is an alkyl group having 1–10 carbon atoms. In the case of the monoethers, n is an integer of 1 to 10, preferably 1 to 5. For the polyols, R is hydrogen, A and $R_1$ are as above described, and n is 4 to 30, preferably 10 to 25.

Examples are ethylene glycol monomethyl ether, ethylene glycol monoethyl ether, ethylene glycol monopropyl ether, ethylene glycol mono-n-butyl ether, ethylene glycol mono-t-butyl ether, ethylene glycol mono-t-amyl ether, diethylene glycol monomethyl ether, diethylene glycol monoethyl ether, diethylene glycol monopropyl ether, diethylene glycol mono-n-butyl ether, diethylene glycol mono-t-butyl ether, diethylene glycol mono-n-amyl ether, diethylene glycol mono-t-amyl ether, triethylene glycol monomethyl ether, triethylene glycol monopropyl ether, triethylene glycol mono-n-butyl ether, triethylene glycol mono-t-butyl ether, triethylene glycol mono-n-amyl ether, triethylene glycol mono-t-amyl ether, propylene glycol monomethyl ether, propylene glycol monoethyl ether, propylene glycol monopropyl ether, propylene glycol mono-n-butyl ether, propylene glycol mono-t-butyl ether, propylene glycol mono-n-amyl ether, dipropylene glycol monomethyl ether, dipropylene glycol monopropyl ether, dipropylene glycol mono-n-butyl ether, dipropylene glycol mono-t-butyl ether, dipropylene glycol mono-n-amyl ether, dipropylene glycol mono-t-amyl ether, tripropylene glycol monomethyl ether, tripropylene glycol monoethyl ether, tripropylene glycol monopropyl ether, tripropylene glycol mono-n-butyl ether, tripropylene glycol mono-t-butyl ether, tripropylene glycol mono-n-amyl ether, tripropylene glycol mono-t-amyl ether, and the like.

Derivatives of 1, 2 butylene oxide which can be used include dibutylene glycol monoethyl ether, dibutylene glycol mono-n-propyl ether, dibutylene glycol mono-isopropyl ether, dibutylene glycol mono-n-butyl ether, dibutylene glycol mono-t-butyl ether, tributylene glycol monoethyl ether, tributylene glycol mono-n-propyl ether, tributylene glycol mono-isopropyl ether, tributylene glycol mono-n-butyl ether, tributylene glycol mono-t-butyl ether, and the like. Corresponding derivatives of 1,3 butylene oxide, 2,3 butylene oxide and 1,4 butylene oxide can be used.

Polyols which can be used include commercially available polypropylene glycol of 1025 molecular weight, polypropylene glycol of 2025 molecular weight, as well as polyisobutylene glycols, poly 1,2 butylene glycols, poly 2,3 butylene glycols and poly 1,4 dihydroxy butylene meeting the above criteria.

Especially preferred additives employed in accordance with the invention are those having the following formula:

$$R-(OCH_2-\underset{\underset{R_1}{|}}{CH}-)_nOH$$

wherein R is a $C_4$ or $C_5$ alkyl group, $R_1$ is hydrogen or $-CH_3$ and n is 1-5 or where R is hydrogen, $R_1$ is methyl, and n is 4 to 30. These preferred glycol monoethers and polyols have good solubilities in diesel fuel hydrocarbons, have superior water partition coefficient characteristics and are effective in reducing particulate matter emissions.

The diesel fuel formulations of the present invention consist essentially by volume of at least 85% diesel fuel hydrocarbons and 0.1 to up to 15% monoether or polyol, preferably about 0.2 to 10% monoether or polyol.

Conventional additives and blending agents for diesel fuel may be present in the fuel compositions of this invention in addition to the above components. For example, the fuels of this invention may contain conventional quantities of such conventional additives as cetane improvers, friction modifiers, detergents, antioxidants, heat stabilizers and the like. Especially preferred diesel fuel formations of the invention consist essentially of diesel fuel hydrocarbons and monoalkyl ether as above described together with peroxidic or nitrate cetane improvers such as ditertiary butyl peroxide, amyl nitrate, ethyl hexyl nitrate and the like.

As described and claimed in copending application PF 50-01-2214, Ser. No. 07,995,496 filed Dec. 23, 1992, now U.S. Pat. No. 5,314,511, the combination of propylene or butylene glycol monoethers or polyols and peroxidic additives has a synergistic effect in reducing fuel consumption as well as reducing emissions and improving fuel economy.

EXAMPLES

To a reference diesel hydrocarbon fuel there were added various oxygenated additives in accordance with the invention. The reference fuel for this work was a typical high quality diesel fuel that will probably see wide-spread use in the United States by 1994. This reference fuel was low sulfur, 370 ppm by weight, in accordance with EPA guidelines, contained 31% by volume aromatics, and the natural cetane number was 43.

To prepare the test fuels, various oxygenated additives, especially alkyl glycol ethers and polyols, were added to the reference fuel. The reference fuel and the test fuel were compared using the standard EPA hot start transient test protocol in a Detroit Diesel Series 60 1991 model heavy duty diesel engine. Results are as follows:

| | EMISSIONS (Grams/BHP-hr.) | | | |
|---|---|---|---|---|
| | HC | CO | NOX | PM |
| REFERENCE FUEL | 0.41 | 1.93 | 4.18 | 0.179 |
| PTB (Vol. %) | | | | |
| 5.0 | 0.34 | 1.72 | 4.34 | 0.158 |
| 2.0 | 0.38 | 1.84 | 4.19 | 0.171 |
| DPTB (Vol. %) | | | | |
| 5.0 | 0.41 | 1.81 | 4.20 | 0.151 |
| TPM (Vol. %) | | | | |
| 5.0 | 0.29 | 1.57 | 4.24 | 0.154 |
| 2.0 | 0.41 | 1.87 | 4.17 | 0.159 |
| 1.0 | 0.40 | 1.97 | 4.21 | 0.163 |
| POLYOL-1025 (Vol. %) | | | | |

-continued

| | EMISSIONS (Grams/BHP-hr.) | | | |
|---|---|---|---|---|
| | HC | CO | NOX | PM |
| 1.0 | 0.39 | 1.92 | 4.18 | 0.168 |

PTB = Propylene Glycol-t-Butyl Ether
DPTB = Dipropylene Glycol-t-Butyl Ether
TPM = Tripropylene Glycol Methyl Ether
Polyol-1025 = Poly(propylene glycol) Polyether Polyol; MW = 1025
HC = Hydrocarbons; CO = Carbon Monoxide; NOX = Nitrogen Oxides, and PM = Particulate Matter.
The above glycol ethers and polyols meet all the qualification tests for use in diesel fuel.

| | FLASH POINT (°C.) | SOLUBILITY (@ 5 VOL. %) |
|---|---|---|
| REFERENCE FUEL | 72 | |
| PTB | 58 | YES |
| DPTB | 74 | YES |
| TPM | 74 | YES |
| POLYOL-1025 | 74 | YES |

Results show that emission reduction can be related to the oxygen concentration contained in the glycol ether or polyol. A plot of ether concentration versus particulate emissions shows a near linear particulate reduction. Depending upon the glycol ether, the particular reductions ranged between 10 to 20%. Sulfate reduction ranges from 12–18%, for example 5% PTB gives 14% sulfate reduction, and soluble organic fraction (SOF) which is unburned fuel residue, ranges from a 15–25% reduction, for example 5% PTB gives 17% reduction in SOF.

Alkyl glycol ethers and polyols of the invention in general give a significant reduction in both aldehyde and ketone emissions. Although currently unregulated, aldehydes, such as acrolein, are significant potential health risks. Typical reductions for 5% PTB are as follows:

| | % REDUCTION |
|---|---|
| ALDEHYDES | |
| $C_1$ | 23 |
| $C_2$ | 22 |
| $C_3$ | 28 |
| ACROLEIN | 25 |
| CROTONAL | 26 |
| BENZALDEHYDE | 35 |
| $C_6$ | 32 |
| KETONES | |
| ACETONE | 39 |
| METHYL ETHYL KETONE | 31 |

Results, however, show that not all oxygenates are effective in reducing particulate emissions. An aliphatic alcohol, aromatic alcohol and a vegetable oil ester were also tested, and results show little or no impact on particulate reduction.

| | EMISSIONS (Grams/BHP-hr.) | |
|---|---|---|
| | NOX | PM |
| REFERENCE FUEL | 4.18 | 0.179 |
| P-SERIES GLYCOL ETHER (5 Vol. %) | 4.20–4.34 | 0.151–0.158 |
| METHYL SOYATE (5 Vol. %) | 4.31 | 0.174 |
| METHYL BENZYL ALCOHOL (5 Vol. %) | 4.33 | 0.174 |
| 1-CYCLOHEXYL ETHANOL (5 Vol. %) | 4.18 | 0.177 |

Many oxygenates fail to meet the selection criteria for use in diesel fuel. Concerns include flash point, fuel solubility, water partitioning, toxicology and durability issues including compatibility with other diesel additives and fuel system elastomers. The target flash point is 52° C. for the base fuel with the oxygenated additive for emission reduction. This is a requirement for transportation of diesel fuel. Solubility of the oxygenated additive in the reference fuel is also important. Highly polar additives do not dissolve well in low aromatic diesel fuels. The other issues is water solubility. The water partition coefficient in 10% water (aqueous/organic) is around 10.0 for TPM versus a greater than 5.0 target established to prevent extraction into a water phase during transport or storage. In addition, the propylene glycol based oxygenates are non-toxic, appear to have no effect on fuel system elastomers, and are completely stable in the presence of various other diesel additives including both alkyl nitrate and peroxide type cetane improvers.

Examples of oxygenates, which fail to meet many of the use criteria, include carbonates. Dimethyl carbonate has, for example, been claimed to reduce diesel emissions in U.S. Pat. Nos. 4,891,049 (1990) and 4,904,279 (1990), both issued to Union Oil. Screening, using the above selection criteria, show dimethylcarbonate is too volatile for use in diesel fuel and is easily extracted into a water phase. Other carbonates also have these problems as well as fuel solubility problems in 30–40% aromatic containing diesel fuels.

| | BLEND FLASH POINT (°C.) | FUEL SOLUBILITY |
|---|---|---|
| DIMETHYL CARBONATE | 29 | YES |
| PROPYLENE CARBONATE | 72 | NO |
| ISOBUTYLENE CARBONATE | 71 | NO |
| METHYL-t-BUTYL CARBONATE | 49 | YES |

The above data demonstrates that alkyl glycol ethers and polyols employed in practice of the invention dramatically reduce diesel particulate emissions. Aldehydes and ketones, which are currently unregulated emissions, are also substantially reduced. Propylene glycol and $C_4$ based alkyl glycol ethers and polyols of the invention are unique and display all the required criteria for use in diesel fuel including flash point, fuel solubility water partition, non-toxicity, compatibility with fuel system components, and with various other diesel additives. In comparative examples, many other classes of oxygenates including aliphatic alcohols, aromatic alcohols, esters and carbonates were shown not to give particulate reductions or they fail to meet all the fuel selection criteria.

The results shown above demonstrate the effectiveness of the glycol monoethers in reducing diesel fuel particulate emissions. Emission reductions of up to 16% were achieved. Particulate reduction depends entirely on the percent oxygen contained in the oxygenated additive. At higher concentrations, greater particulate reduction would be expected. In most cases hydrocarbon and carbon monoxide emissions were also substantially reduced.

I claim:

1. A fuel composition having a flash point of at least 52° C. consisting essentially of hydrocarbons boiling in the diesel fuel range and containing not more than 500 ppm sulfur said hydrocarbons comprised of 20–35% by volume aromatics, and a particulate emission reducing amount of an additive having the formula $$R-(O-\underset{\underset{R_1}{|}}{A}-)_nOH$$

wherein A is a $C_2$ alkylene group, $R_1$ is an alkyl group having 1–2 carbon atoms, R is hydrogen and n is 10 to 25.

2. The fuel composition of claim 1 wherein $R_1$ is a methyl group.

3. The fuel composition of claim 1 wherein $R_1$ is a $C_2$ alkyl group.

4. The fuel composition of claim 1 which contains at least 85 vol. % diesel fuel hydrocarbons.

5. The fuel composition of claim 1 which contains 0.1 to 15 vol. % of said additive.

6. The fuel composition of claim 1 which contains 0.2 to 10 vol. % of said additive.

* * * * *